US008457343B2

(12) United States Patent
Zhu

(10) Patent No.: US 8,457,343 B2
(45) Date of Patent: Jun. 4, 2013

(54) SAFE IN-EAR EARPHONES

(76) Inventor: Aidao Zhu, Zhejiang (CN)

( * ) Notice: Subject to any disclaimer, the term of this patent is extended or adjusted under 35 U.S.C. 154(b) by 112 days.

(21) Appl. No.: 13/119,961

(22) PCT Filed: Jun. 17, 2009

(86) PCT No.: PCT/CN2009/000660

§ 371 (c)(1),
(2), (4) Date: Mar. 19, 2011

(87) PCT Pub. No.: WO2010/043097

PCT Pub. Date: Apr. 22, 2010

(65) Prior Publication Data

US 2011/0170730 A1 Jul. 14, 2011

(30) Foreign Application Priority Data

Oct. 15, 2008 (CN) ..... 2008 1 0167226

(51) Int. Cl.
*H04R 25/00* (2006.01)

(52) U.S. Cl.
CPC ..... *H04R 25/00* (2013.01)
USPC ..... 381/380; 381/382; 381/384

(58) Field of Classification Search
USPC ..... 381/380, 382, 384
See application file for complete search history.

(56) References Cited

U.S. PATENT DOCUMENTS

| | | | | | |
|---|---|---|---|---|---|
| 4,090,042 | A * | 5/1978 | Larkin | 379/430 |
| 4,173,715 | A * | 11/1979 | Gosman | 381/382 |
| 4,261,432 | A * | 4/1981 | Gunterman | 181/137 |
| 4,677,679 | A * | 6/1987 | Killion | 381/74 |
| 4,852,177 | A * | 7/1989 | Ambrose | 381/338 |
| 4,852,683 | A * | 8/1989 | Killion | 181/130 |
| 5,022,486 | A * | 6/1991 | Miura et al. | 181/132 |
| 6,411,722 | B1 * | 6/2002 | Wolf | 381/371 |
| 6,453,044 | B1 * | 9/2002 | Klitzner et al. | 379/430 |
| 6,505,036 | B2 * | 1/2003 | Zilberberg et al. | 455/117 |
| 6,631,279 | B2 * | 10/2003 | Rivera | 455/575.2 |
| 6,920,228 | B2 * | 7/2005 | Redmer et al. | 381/370 |
| 8,094,849 | B2 * | 1/2012 | Freels et al. | 381/322 |
| 2001/0027089 | A1 * | 10/2001 | Salam | 455/90 |
| 2002/0080979 | A1 * | 6/2002 | Brimhall et al. | 381/72 |
| 2002/0086715 | A1 * | 7/2002 | Sahagen | 455/568 |
| 2003/0176164 | A1 * | 9/2003 | Hefetz | 455/3.06 |
| 2004/0077382 | A1 * | 4/2004 | Verity | 455/569.1 |
| 2004/0082359 | A1 * | 4/2004 | Choi et al. | 455/556.1 |
| 2007/0224933 | A1 * | 9/2007 | Mayer | 455/15 |
| 2008/0013771 | A1 * | 1/2008 | Zhu | 381/374 |
| 2012/0114162 | A1 * | 5/2012 | Zheng | 381/384 |

FOREIGN PATENT DOCUMENTS

WO PCT/CN2009/000660 8/2009

* cited by examiner

*Primary Examiner* — Duc Nguyen
*Assistant Examiner* — Sean H Nguyen
(74) *Attorney, Agent, or Firm* — Global IP Services; Tianhua Gu

(57) ABSTRACT

A safe in-ear earphone for radiation protection comprises earplug heads, sound cavities, acoustic wave transmission channels, a main body, a conductor and a plug. The channels are set between the sound cavities and loudspeakers. The acoustic wave concentrated orifices are between the loudspeakers and the acoustic wave transmission channels. The assembly of the loudspeakers, the acoustic wave concentrated orifices and the acoustic wave transmission channels are sealed to form a sealed small boxes in the main body. The shape of acoustic wave concentrated orifices is inverse loudhailer. The acoustic wave is transmitted to the two acoustic wave channels via the acoustic wave concentrated orifices and then is provided to the ears plugged by two earplugs to listen.

8 Claims, 11 Drawing Sheets

A – A Section view
Diagram

A – A Section view

A – A section view

C-C section view

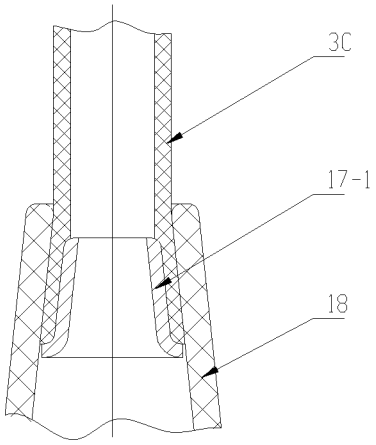
Fig. 11-1
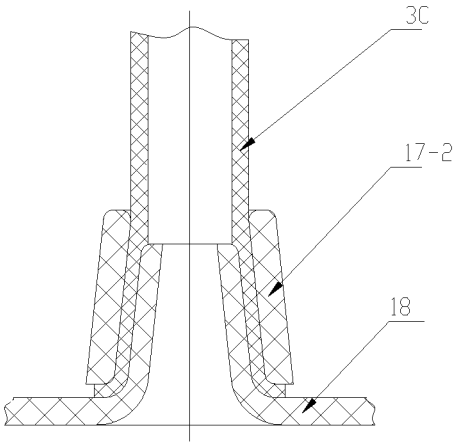
Fig. 11-2
Fig. 11

SAFE IN-EAR EARPHONES

CROSS REFERENCE TO RELATED PATENT APPLICATION

The present patent application is the US national stage of PCT/CN2009/000660 filed on Jun. 17, 2009, which claims the priority of the Chinese patent application No. 200810167226.5 filed on Oct. 15, 2008, that application is incorporated herein by reference.

FIELD OF THE INVENTION

This invention is related to a safety earplug device for protection from radiation. Specifically, the earplug device is adapted to be used for communication devices having high frequency magnetic field and intense radiation, such as a mobile phone. Especially, relates to a new kind of earphones, of which the frequency response is really improved, and a better stereo sounding effect is produced.

BACKGROUND OF THE INVENTION

The ordinary earphone such as ones put in the mobile phone, including a plug, a conductor and earplug heads, micro-loudspeakers installed in the earplug. As a result of the direct use of the phone, the high-frequency magnetic field or other harmful radiation light caused by the mobile phone will intensely stimulate nerves of people's brain and have a great harm to people's health. People use earphone to answer a call in order to reduce the harm caused by different kinds of radiation as high frequency magnetic field and electric wave, thermal energy. However, the earphone with a speaker in the earplug heads is still unable to avoid the danger from transmitting the radiation of the high-frequency magnetic field to ears and brain. In addition, the 1600 G permanent magnet earplugs with loudspeakers also have drastic harm to the people's brain. So, use of mobile phones or ordinary earphones for a long time can easily cause a symptom of headache, dizziness, or numbness etc.

An existing anti-electromagnetic radiation earphone, for instance, a product named radiation free earphone with the patent number ZL02244828.4, can reduce electromagnetic radiation, however, its wave passage is too short, only 5-10 cm long, hard to reach requirements of 2 mG or under 2 mG that is harmless to people's health according to the theory of Professor Shi Min, the inventor of the cell phone, PHD of American Stanford University, academician of American Academy of Engineering, and professor of Taiwan Communication University. So the existing earphone cannot meet the requirement of anti-electromagnetic radiation as mentioned above, also have not a sound room, thus responding to the frequency is not well created. Aidao Zhu' Chinese patent application No. 200610028981.6 titled "Safe Earphone" disclosed a safe earphone having a sound wave transmission passage; however he didn't disclose a concrete length of the sound wave transmission passage. Aidao Zhu's Chinese patent publication No. CN 101227756A titled "Safe Earphone", which disclosed the concrete length of the sound wave transmission passage, but it didn't disclosed the sound wave collector, sound wave-division passage airproof of speaker, and fastening of switch and sound wave transmission passage.

As mentioned above, people extraordinarily need a kind of earphone which can really reduce electromagnetic radiation, has a good frequency response, has a better improve in the frequency response and has a good stereo sounding effect.

SUMMARY OF THE INVENTION

This invention is to provide a kind of safe earphone which can really avoid damage caused by high-frequency magnetic field, electric wave and thermal energy radiation to people's brain and body. In addition, it also has a better frequency response effect and improved stereo sounding effect.

To find a solution for the danger stated above, this invention separates loudspeakers from the earplugs. And one or two acoustic wave transmission channels are placed between micro loudspeakers and earplugs. Sound waves produced by a mini speaker are transmitted to people's ears via the acoustic wave transmission channels and sound cavities. Especially, in the present invention a sound receiving hole is created, which is set in a safety earplug device. The sound receiving hole is sealed up with the speaker and the acoustic wave transmission channel terminal to form a sealed box in the main body. On one hand, all sound wave produced by the micro loudspeaker can efficiently reach people's ears via the acoustic wave transmission channel after collecting by the acoustic wave concentrated orifices that is inversely conical and is opposite to the loudspeaker in sidewise or face to face. The above-mentioned process will not diminish the power but the frequency response can be improved greatly. On the other hand, it will not disturb a microphone located in the main body. In addition, people can answer a phone call by pressing a switch. The new design efficiently protect people's brain and other organs from the damage of the radiation which caused by the strong radiation while answering the phone call. Well designed two acoustic wave transmission channels can transmit separately to two ears via one loudspeaker, which produces a brilliant stereo sounding effect.

TECHNICAL SOLUTION OF THIS INVENTION

A safe in-ear earphone comprising:

an earplug with cover;

a sound cavity having a cavity with an outlet, the earplug cover covers on the cavity;

a main body having a space for an electronic control plate and a sealed box 11 which is defined by a micro-loudspeaker an acoustic wave concentrated orifice and a connecting interface;

the acoustic wave concentrated orifices has an inversely conical shape, a small top of the inversed conic is an open hole with a connecting outlet;

the micro-loudspeaker is covered on a big bottom of the inversed conic; the front face of the micro-loudspeaker is against the connecting outlet in sidewise or aspectant;

an acoustic wave transmission channel being a slim hose or hard tube, which connects the sound cavity at one end and the connecting outlet at other end;

a plug, which connects the electronic control plate by a conducting line made of metal shielding line.

the earplug having the sound cavity therein is plug in a ear for listening, the main body having the micro-loudspeaker therein is far away the earplug and is connected with the earplug by the acoustic wave transmission channel, sound from micro-loudspeaker passes through the acoustic wave concentrated orifice and the acoustic wave transmission channel enters in the sound cavity for listening, thereby the ear is far away the high frequency magnetic field and intense radiation from the micro-loudspeaker or mobile phone.

The safety earplug device comprises one or two earplug heads and covers (1), sound cavities (2), acoustic wave transmission channels (3), a main body (4), a micro-loudspeaker or loudspeaker (5), a microphone (6), a conductor (8) and a plug (9). The acoustic wave transmission channels (3) are placed between the sound cavities (2) and the loudspeakers (5), the loudspeakers (5) are round or ellipse; the acoustic wave transmission channels (3) are slim hoses or hard tubes, and are made of insulating materials. The micro loudspeaker (5) and microphone (6) are placed in the main body (4). The acoustic wave transmission channels connect the main body (4), the micro loudspeaker (5) at on one end with the earplug/cover (1) at the other end. The slim channel in the middle is the acoustic wave transmission channels (3). The micro loudspeaker (5), microphone (6), conductor (8) and plug (9) are connected in sequence. The conductor is metal shield line; the length of the acoustic wave transmission channels (3) is 155 mm-600 mm or 155 mm-600 mm, the inner diameter of the acoustic wave transmission channels (3) is 2-4 mm, the volume of the sound cavities (2) is 600 $mm^3$-3000 $mm^3$, outlet of the sound cavities which makes sound cavities a small sound box has one or several small holes of which diameter is 1.5 mm-4 mm or 0.3-1.5 mm.

A Piece of Safe In-Ear Earphones Comprises:

1) An acoustic wave concentrated orifice (10) is set between the micro-loudspeaker (5) and the acoustic wave transmission channels (3). A sealed small box (11) is placed in the main body (4). The assembly of the acoustic wave concentrated orifices (10), the loudspeakers (5) and the acoustic wave transmission channels is sealed to form a sealed box; the acoustic wave produced by the micro-loudspeaker is transmitted to the two acoustic wave channels (3) via the acoustic wave concentrated orifices (10) and the shunt channels, and is enabled to be heard while plugging two earplugs in the ears; the microphone (6) and a switch (12) are placed in the main body (4). The angle between two pairs of the bevel/arc/curve edges of the acoustic wave concentrated orifices (10) peripheral is symmetrical, the acoustic wave concentrated orifices (10) is inverse loudhailer. The angle between two pairs of bevel/arc/curve edges of the acoustic wave concentrated orifices (10) peripheral is symmetrical 9-130°; one or both of the angles are inverse loudhailers. Both of angles are both inverse loudhailer. Or, one of angles can be inverse loudhailer while another is parallel. Cross section of the inverse loudhailer and the bottom surface of the cone are rectangle or polygon with 4 circular angles or right angles. The inverse loudhailer can be made with a shape of ellipse. Or, it is rectangle at the big end and round at the small end. (see FIGS. 5, 6, 7). The angle between the bevel/arc/curve edges and a centerline is 4.5° or 130°: the angle between two pairs of the bevel/arc/curve edges of the acoustic wave concentrated orifices (10) peripheral is unsymmetrical 65° or unsymmetrical 1-65° & 65-1°, meaning that the angle between the two pairs of the bevel/arc/curve edges of the acoustic wave concentrated orifices (10) peripheral is unsymmetrical: the angle between left bevel/arc/curve edges and the centerline is 1-65° while the angle between right bevel edge and the centerline is 65-1° or vice versa.

2) Sound produced by the micro-speaker (5) is transmitted to the two acoustic wave channels via the acoustic wave concentrated orifices (10) and can be heard while plugging earplugs in the ears.

3) The loudspeakers are sealed in a small box, microphones sealed in another small box in the main body with their sound receiving side outward so that the sound can be transmitted to microphones via the sound receiving holes (one or more) on the main body and then through sound receiving holes (one or more) on the surface of the microphone, therefore, there is no echo or noise in the microphone to interfere with sound waves of the loudspeakers.

4) Two ways to tighten acoustic wave transmission channels to improve tensile strength as follows, one of both methods should be selected when tightening:

(1) One end of acoustic wave transmission channels 3C is fixed in earplug's inlet while the other end fixed in main body's outlet. The acoustic wave transmission channels at both ends are bulged by hollow rivets 17-1.

(2) Earplug's inlet and main body's outlet are sheathed by acoustic wave transmission channels. Acoustic wave transmission channels' ends are tightened by sheaves 17-2.

This is to certify that 110-600 mm acoustic wave transmission channels 3 were proposed when applying for PCT, that 155-600 mm acoustic wave transmission channels 3 were proposed when applying for application documents before, that acoustic wave concentrated orifices are between the loudspeakers (5A, 5B) and the acoustic wave transmission channels are sealed in small boxes, and the acoustic wave is transmitted to two acoustic wave channels (3A, 3B) via the acoustic wave concentrated orifices (10A, 10B) and the shunt channels and to be heard while plugging two earplugs in the ears, Above mentioned matter is proposed when applying for PCT.

The acoustic wave concentrated orifice which is a cone shaped by straight line, arc or curve perfectly transmits acoustic wave to the acoustic wave transmission channels.

The safety earplug device is featured that: the acoustic wave concentrated orifices are inverse loudhailer shaped (cone shaped) as to 1) Inverse loudhailer peripheral being arc inverse loudhailer shaped;
2) Inverse loudhailer peripheral being slope inverse loudhailer shaped;
3) Inverse loudhailer peripheral being curve inverse loudhailer shaped;
4) Inverse loudhailer peripheral being shaped by arc (or curve) inverse loudhailer and slope inverse loudhailer together.

The angle between the two pairs of bevel/arc/curve edges of the acoustic wave concentrated orifices (10) peripheral is unsymmetrical 60° meaning that the angle between two pairs of bevel/arc/curve edges of the acoustic wave concentrated orifices (10) peripheral is unsymmetrical: the angle between left bevel/arc/curve edges and the centerline is 51° while angle between the right bevel edge and the centerline is 9° or vice versa.

The safety earplug device is featured that: the angle between two pairs of the bevel/arc/curve edges of the acoustic wave concentrated orifices (10) peripheral which is unsymmetrical 40° means that the angle between two pairs of the bevel/arc/curve edges of the acoustic wave concentrated orifices (10) peripheral is unsymmetrical: the angle between left bevel/arc/curve edges and the centerline is 35° while angle between right bevel edge and the centerline is 5° or vice versa.

The safety earplug device is featured that: micro-loudspeaker (5) is placed vertically in the main body (4).

The safety earplug device is featured that: micro-loudspeaker (5) is placed flat or leaning in main body (4).

The safety earplug device is featured that: micro-loudspeaker (5) is round or ellipse.

The safety earplug device can be used in MP3 or MP4 with rich basses.

Advantages of the Safety Earplug Device in this Invention:

1. The safety earplug device is a new invention based on an existing applicant's invention titled as Type of Earplug Device (CN200810000676.5) which is filed in 2008. so the safety earplug device has all advantages as the previous invention of earplug device has, for instance, radiation intensity is limited to 2 mG or less. As its acoustic wave transmission channels are lengthened the target set by one of cell phone inventors Professor Shi Min' theory, 1.8 mG or less magnetic radiation has no harm to human brain body, can be achieved.

2. The assembly of acoustic wave concentrated orifices (10), the loudspeakers (5) and the acoustic wave transmission channels are sealed to form a sealed small boxes, the acoustic wave concentrated orifice (10) which is set between the micro-loudspeaker (5) and the acoustic wave transmission channels (3) improves tremendously the response of high and low frequency without sound distortion. If no acoustic wave concentrated orifice is set, both high and low frequency attenuation will be very huge causing no power to output. As a result, serious sounding distortion will happen.

3. Speakers are sealed in a small box; microphone is sealed in another small box with its sound receiving side outward so that sound can be transmitted to microphone via sound receiving holes (one or more) on the main body and then through sound receiving holes (one or more) on the surface of microphone, therefore, there is no echo and noise produced in microphone to interfere with loudspeakers.

4. The acoustic wave concentrated orifice is set to improve frequency response. The frequency response is improved when the acoustic wave is transmitted to two acoustic wave channels via the acoustic wave concentrated orifices and the shunt channels and is sent to be heard while two earplugs are plugged in the ears 5. Because radiation is the strongest at the moment of answering a phone call, an on/off switch is set in the main body of the safety earplug device to keep a distance from mobile phones so that it can reduce harm caused by mobile phone radiation.

6. One loudspeaker which can be shared by two ears of one person produces a stereo sounding effect. Or, two person share one earphone to lower the cost, it especially suit for the young to use.

7. In addition, compared to the device with two loudspeakers, modal one device with only one speaker has a small shell. Its speaker's diameter is larger, so that the speaker can produce better low frequency response and the cost will be reduced;

8. Tensile strength of the safety earplug device is 2 kg or more after two ways of fastening stated above.

To testify radiation-proof effect of the safety earplug device, Shanghai Zhongchangjiang Automobile Electronic Appliances Co., Ltd (Aidao Zhu is both the legal representative of the company and the applicant and inventor of the invention) requests Shenzhen Centre Testing International Corporation (CTI) to do contrast test for electromagnetic radiation intensity of FMJ radiation-proof earphone (the safety earplug device Mr. Aidao Zhu invented), mobile phones and ordinary earphone. The test time is May 15, 2008. Test instrument is made by ETS-LINDGERN in American.

Testing Steps:

1. Test background noise by peak detection with 10 seconds detector scanning and recorded the result.
2. Place earphone on a test table of 80 cm height while test detector is 2 mm away from both a mobile phone and its earplug.
3. Place a mobile phone and its earplug 2 mm far from the front of fixed magnetic detector. (For details about Figs of test earphones and FMJ radiation-proof earplug devices, see the report of contrast test for electromagnetic radiation intensity.)

Test pattern: test by peak detection and 10 seconds maximum maintaining function detector scanning; record readings on the talk time, at the moment of answering a call, on an outgoing call and on an incoming call.

Test Data:

Ambient Noise: 0.68 $\mu W/cm^2$

1. Place FMJ radiation-proof earplug device earplug 2 mm far from the front of fixed magnetic detector. Test by patterns as follows and record readings; Place mobile phone aerial terminal 2 mm far from the front of fixed magnetic detector. Test by patterns as follows and record readings. See FIG. 1 about the contrast test result of FMJ radiation-proof earplug devices and mobile phones:
   FIG. 1 (Radiation power density unit:$\mu W/cm^2$)

| | Items | |
|---|---|---|
| Test state | Mobile phone connected with FMJ radiation-proof earphone ($\mu W/cm^2$) | Mobile phone ($\mu W/cm^2$) |
| Standby | 0.68 | 0.71 |
| Talking on the phone | 2.69 | 7107.10 |
| Signal receiving | 7.74 | 12523.01 |
| Calling | 7.37 | 1363.81 |
| Ringing | 6.68 | 1367.82 |

2. Place FMJ radiation-proof earplug device earplug 2 mm far from the front of fixed magnetic detector. Test by patterns as follows and record readings; Place ordinary earphone earplug 2 mm far from the front of fixed magnetic detector. Test by patterns as follows and record readings. See FIG. 1 about the contrast test result of FMJ radiation-proof earplug devices and ordinary earphones:
   FIG. 2 (Radiation power density unit:$\mu W/cm^2$)

| | Items | |
|---|---|---|
| Test state | Mobile phone connected with FMJ radiation-proof earphone ($\mu W/cm^2$) | Mobile phone connected with common earphone ($\mu W/cm^2$) |
| Standby | 0.68 | 0.70 |
| Talking on the phone | 2.69 | 40.97 |
| Signal receiving | 7.74 | 98.93 |
| Calling | 7.37 | 35.01 |
| Ringing | 6.68 | 37.94 |

DISCUSSION

1. We found from FIG. 1 that electromagnetic radiation intensity of mobile phones with FMJ radiation-proof earplug device is 0.96 time that of mobile phones on the standby mode; electromagnetic radiation intensity of mobile phones with FMJ radiation-proof earplug device is 0.00038 time that of mobile phones on the talk time; electromagnetic radiation intensity of mobile phones with FMJ radiation-proof earplug device is 0.00062 time that of mobile phones at the moment of answering a call; electromagnetic radiation intensity of mobile phones with FMJ radiation-proof earplug device is 0.0054 time that of mobile phones on an outgoing call; electromagnetic radiation intensity of mobile phones with FMJ radiation-proof earplug device is 0.0049 time that of mobile phones on a incoming call; Electromagnetic radiation intensity is reduced dramatically on the talk time, at the moment of answering a call on an outgoing call and on an incoming call.

2. We found from FIG. 2 that electromagnetic radiation intensity of mobile phones with FMJ radiation-proof earplug device is 0.97 time that of mobile phones with ordinary earphones on the standby mode; electromagnetic radiation intensity of mobile phones with FMJ radiation-proof earplug device is 0.0678 time that of mobile phones with ordinary earphones on the talk time; electromagnetic radiation intensity of mobile phones with FMJ radiation-proof earplug device is 0.078 time that of mobile phones with ordinary earphone at the moment of answering a call; electromagnetic radiation intensity of mobile phones with FMJ radiation-proof earplug device is 0.211 time that of mobile phones with ordinary earphones on an outgoing call; electromagnetic radiation intensity of mobile phones with FMJ radiation-proof earplug device is 0.176 time that of mobile phones with ordinary earphones on an incoming call; electromagnetic radiation intensity is reduced dramatically on the talking time, at the moment of answering a call while intensity is reduced on an outgoing call and on an incoming call.

As stated: harm caused by radiation to human brain and body can be reduced dramatically after using FMJ radiation-proof earphone (the safety earplug device). Therefore, the safety earplug device that Mr. Aidao Zhu invented can protect people from radiation contributes to our environment and society.

BRIEF DESCRIPTION OF THE DRAWINGS

FIG. 11 is the Fig. of fastening ways of acoustic wave transmission channels:

FIG. 11-1: Rivet fastening

FIG. 11-2: bushing fastening

Figure 1:
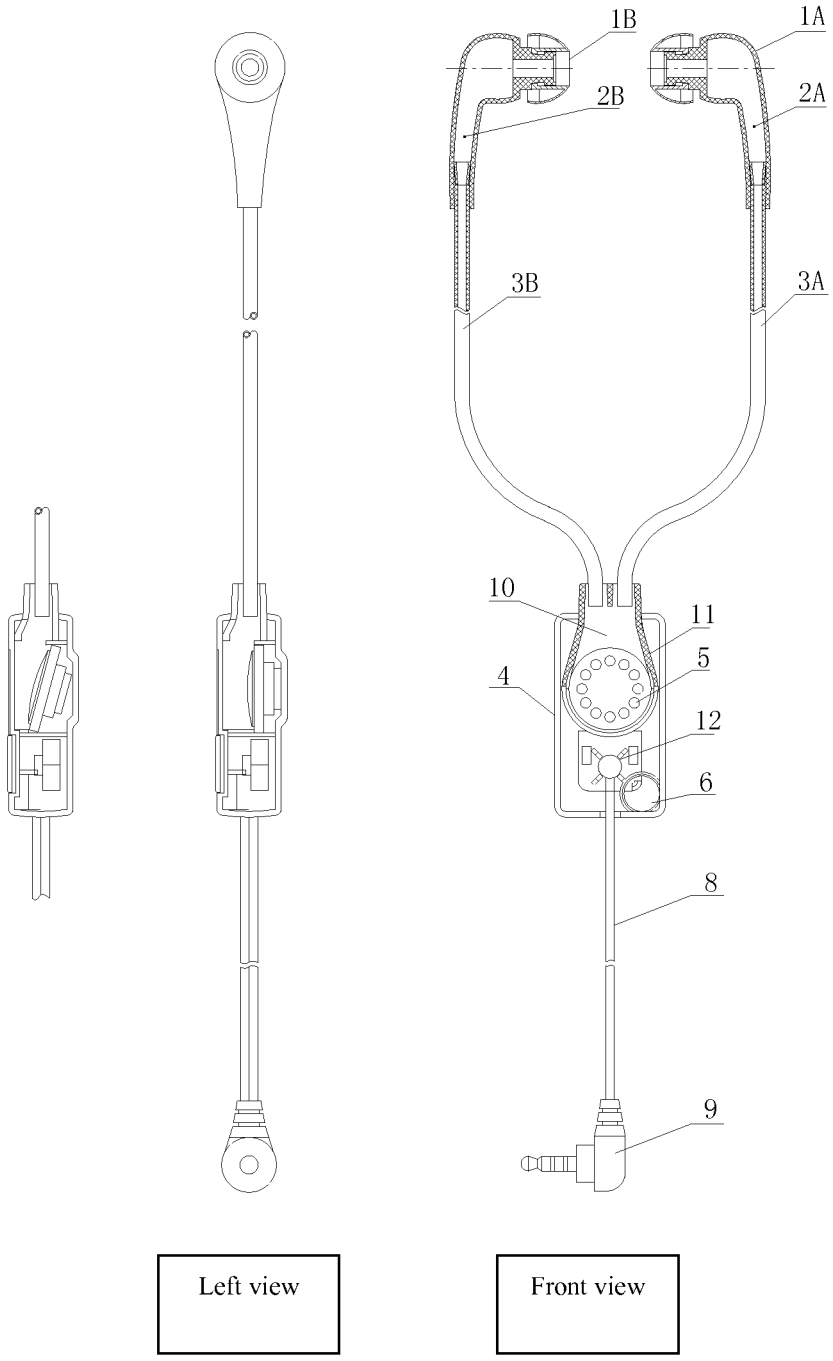
FIG. 1: A safety earplug device has two loudspeakers which are placed flat or slant and two acoustic wave transmission channels.

Notes: 1, 1A,1B are earplug head and covers, 2, 2A, 2B are sound cavities, 3, 3A, 3B, 3C are acoustic wave transmission channels, 4 is the main body, 5, 5A, 5B are micro-loudspeakers, 6 is the microphone, 8 is a conductor, 9 is the plug, 10,10A,10B are acoustic wave concentrated orifices, 11,11A, 11B are sealed small boxes, 12 is a switch, 13 is receiver, 14 is sound receive holes, 15 is sound receive face of microphone, 16 is arc or straight line, 17-1, 17-2 is rivet and cover. 18 is inlet or outlet of acoustic waves.

DETAIL DESCRIPTION OF THE INVENTION

Embodiment 1

A safety earplug device comprises earplug heads and covers (1), sound cavities (2), acoustic wave transmission channels (3), a main body (4), micro-loudspeaker (5), a microphone (6), a conductor (8) and a plug (9); the channels (3) are placed between the cavities (2) and loudspeakers (5) which are round or ellipse, the length of the channels (3) is slim hose or hard tube. The acoustic wave transmission channels (3) are made of insulating materials. The micro loudspeaker (5) and the microphone (6) are placed in the main body (4). The acoustic wave transmission channels connect the main body (4) and the micro loudspeaker (5) at one end with the earplug and cover (1) at the other end. The slim channel in the middle is the acoustic wave transmission channels (3). The micro loudspeaker (5), the microphone (6), the conductor (8) and the plug (9) are connected in sequence. The conductor is metal shield line. The length of acoustic wave transmission channel (3) is 110 mm; the inner diameter of acoustic wave transmission channel (3) is 2 mm, the volume of sound cavities (2) is 600 $mm^3$; Outlet of sound cavities (2) which makes sound cavities a small sound box has one 1.5 mm or several 0.3 mm small holes.

The safety earplug device is featured that:

1) An acoustic wave concentrated orifice (10) is set between the micro-loud speaker (5) and the acoustic wave transmission channels (3). A sealed small box (11) is placed in the main body (4). The assembly of the acoustic wave concentrated orifices having connecting outlet (10), loudspeakers (5) and acoustic wave transmission channels (3) are sealed to form a small boxes (11) in the main body (4), the microphone (6) and the switch (12) are placed in the main body (4). The acoustic wave concentrated orifices (10) are inversely conical and opposite to the loudspeaker in sidewise or face to face. The cross section of the inversely conical concentrated orifices are ellipse or polygon.

The angle between the two pairs of bevel/arc/curve edges of the acoustic wave concentrated orifices (10) peripheral is symmetrical 90°. Both angles are inverse loudhailer. One of angles can be inverse loudhailer while another is parallel.

Cross section of inverse loudhailer and bottom surface of the cone are rectangle or polygon with 4 circular angles or right angles. It can be made with a shape of ellipse. Or it is rectangle in the big end and round in the small end. The angle between the bevel/arc/curve edges and centerline is 4.5°; the angle between the two pairs of bevel/arc/curve edges of the acoustic wave concentrated orifices (10) peripheral is unsymmetrical 1° or 65°. Asymmetry here stated refers to the angle between the two pairs of bevel edges of the acoustic wave concentrated orifices (10) peripheral is unsymmetrical. The angle between the left bevel/arc/curve edges and centerline is 1° while angle between the right bevel edge and centerline is 65° or vice versa.

2) Sound produced by the loudspeakers (5) is transmitted to the two acoustic wave channels via the acoustic wave concentrated orifices (10), and then through the acoustic wave transmission channel sent to the two earplugs for listening by ears.

3) The loudspeakers are sealed in a small box; the microphones sealed in another small box in the main body with their sound receiving side outward so that sound can be transmitted to microphone via sound receiving surface and then sound receiving holes (one or more); therefore, there is no echo and noise in the microphone to interfere with the loudspeakers.

4) Two ways to tighten acoustic wave transmission channels to improve tensile strength are stated as follows:

One end of the acoustic wave transmission channels 3C is fixed in earplug's inlet while the other end fixed in the main body's outlet. The acoustic wave transmission channels at both ends are bulged by hollow rivets 17-1.

The acoustic wave concentrated orifice which is a cone shaped by straight line, arc or curve perfectly transmits the acoustic wave to the acoustic wave transmission channels.

Embodiment 2

The safety earplug device comprises the earplug heads and covers (1), the sound cavities (2), the acoustic wave transmission channels (3), the main body (4), the micro-loudspeaker (5), the microphone (6), the conductor (8) and the plug (9), the channels (3) are placed between the cavities (2) and the loudspeakers (5), the loudspeakers is round or ellipse, the length of the channels (3) is slim hose or hard tube. The acoustic wave transmission channels (3) are made of insulating materials. The micro loudspeaker (5) and the microphone (6) are placed in the main body (4). The acoustic wave transmission channels (3) connect the main body (4) and the micro loudspeaker (5) on one end with the earplug and cover (1) on the other end. The slim channel in the middle is the acoustic wave transmission channels (3). The micro loudspeaker (5), the microphone (6), the conductor (8) and the plug (9) are connected in sequence. The conductor (8) is metal shield line. the length of acoustic wave transmission channel (3) is 155 mm; the inner diameter of acoustic wave transmission channel (3) is 2 mm, the volume of sound cavities (2) is 600 $mm^3$; Outlet of sound cavities has one 4 mm or several 1.5 mm small holes, and then makes sound cavities a small sound box.

The safety earplug device is featured as:

1) An acoustic wave concentrated orifice (10) being set between micro-loudspeaker (5) and acoustic wave transmission channels (3); a sealed small box (11) being placed in the main body (4); the joint of acoustic wave concentrated orifices having connecting outlet (10), the loudspeakers (5) and the acoustic wave transmission channels being sealed in sealed small boxes (11) in the main body (4); microphone (6) and switch (12) being placed in main body (4). The acoustic wave concentrated orifices (10) is inversely conical and is opposite to the loudspeaker in sidewise or face to face. The cross section of the inversely conical concentrated orifice is ellipse or polygon.

The angle between the two pairs of bevel/arc/curve edges of the acoustic wave concentrated orifices (10) peripheral is unsymmetrical 100°, which means that the angle is 100°. The angle between the left bevel/arc/curve edges and centerline is 50°. One of or both of angles are all inverse loudhailer. Both angles are inverse loudhailer. One of angles can be inverse loudhailer while another is parallel. Cross section of inverse loudhailer and bottom surface of the cone are rectangle or polygon with 4 circular angles or right angles. It can be made with a shape of ellipse. Or it is rectangle in the big end and round in the small end. The angle between the two pairs of bevel/arc/curve edges of the acoustic wave concentrated orifices (10) peripheral is unsymmetrical 15° or 50°. Asymmetry here stated refers to the angle between the two pairs of bevel edges of the acoustic wave concentrated orifices (10) peripheral is unsymmetrical. The angle between the left bevel/arc/curve edges and centerline is 15° while angle between the right bevel edge and centerline is 50° or vice versa.

2) Sound produced by the loudspeakers (5) is transmitted to two acoustic wave channels via the acoustic wave concentrated orifices (10) and then through the acoustic wave transmission channel channels is provided to the two earplugs for listening by ears.

3) The loudspeakers are sealed in a small box; the microphones are sealed in another small box in main body with its sound receiving side outward so that sound can be transmitted to microphone via sound receiving holes (one or more) on the main body and then through sound receiving holes (one or more) on the surface of the microphone; therefore, there is no echo and noise in microphone to interfere loudspeakers.

4) Two ways to tighten acoustic wave transmission channels to improve tensile strength as follows:

Earplug heads inlet and main body outlet are sheathed by the acoustic wave transmission channels. The acoustic wave transmission channels ends are tightened by sheaves 17-2.

Embodiment 3

The safety earplug device comprises the earplug heads and covers (1), the sound cavities (2), the acoustic wave transmission channels (3), the main body (4), micro-loudspeaker (5), the microphone (6), the conductor (8) and the plug (9); the channels (3) are placed between the cavities (2) and the loudspeakers (5), the loudspeakers are round or ellipse, the length of the channels (3) is slim hose or hard tube. The acoustic wave transmission channels are made of insulating materials. The micro loudspeaker (5) and the microphone (6) are placed in the main body (4). The acoustic wave transmission channels connect the main body (4) and the micro loudspeaker (5) on one end with the earplug and cover (1) on the other end. The slim channel in the middle is the acoustic wave transmission channels (3). The micro loudspeaker (5), the microphone (6), the conductor (8) and the plug (9) are connected in sequence. The conductor is metal shield line. The length of acoustic wave transmission channel (3) is 600 mm; the inner diameter of acoustic wave transmission channel (3) is 2 mm; the volume of sound cavities (2) is 600 $mm^3$; outlet of sound cavities has one 4 mm or several 1.5 mm small holes, and makes sound cavities a small sound box.

The safety earplug device is featured that:

1) an acoustic wave concentrated orifice (10) is set between micro-loudspeaker (5) and acoustic wave transmission channels (3). A sealed small box is placed in the main body (4).

The assembly of the acoustic wave concentrated orifices having outlet (10), the loudspeakers (5) and the acoustic wave transmission channels is sealed to form a sealed small boxes (11) in the main body (4); the microphone (6) and the switch (12) are placed on the main body (4). The acoustic wave concentrated orifices (10) are inversely conical and are opposite to the loudspeaker sidewise or face to face. The cross section of the inversely conical concentrated is ellipse or polygon.

The angle between the two pairs of bevel/arc/curve edges of the acoustic wave concentrated orifices (10) peripheral is symmetrical 100°, which means that the angle is 100°. The angle between the left bevel/arc/curve edges and centerline is 50°. One or both of the angles are inverse loudhailer. Both angles are inverse loudhailer. One of the angles can be inverse loudhailer while the other is parallel. inverse loudhailer and bottom surface of the cone are rectangle or polygon with 4 circular angles or right angles. It can be made with a shape of ellipse. Or it is rectangle in the big end and round in the small end. The angle between the two pairs of bevel/arc/curve edges of the acoustic wave concentrated orifices (10) peripheral is unsymmetrical 15° or 50°. Asymmetry here stated refers to the angle between the two pairs of bevel edges of the acoustic wave concentrated orifices (10) peripheral is unsymmetrical. The angle between the left bevel/arc/curve edges and centerline is 15° while angle between the right bevel edge and centerline is 50° or vice versa.

2) Sound produced by micro-speaker (5) is transmitted to the two acoustic wave channels via the acoustic wave concentrated orifices (10) and then through the acoustic wave transmission channel is provided to the two earplugs for listening by ears.

3) The loudspeakers are sealed in a small box; the microphones sealed in another small box in the main body with their sound receiving side outward so that sound can be transmitted to microphone via sound receiving holes (one or more) on the main body and then through sound receiving holes (one or more) on the surface of the microphone; therefore, there is no echo and noise in microphone to interfere loudspeakers.

4) Two ways to tighten acoustic wave transmission channels to improve tensile strength as follows, one of both methods should be selected when tightening:

One end of the acoustic wave transmission channels 3C is fixed in the earplug's inlet while the other end fixed in the main body's outlet. The acoustic wave transmission channels at both ends are bulged by hollow rivets 17-1.

Embodiment 4

The safety earplug device comprises the earplug heads and covers (1), the sound cavities (2), the acoustic wave transmission channels (3), the main body (4), the micro-loudspeaker (5), the microphone (6), the conductor (8) and the plug (9), the channels (3) are placed between the cavities (2) and the loudspeakers (5), the length of the channels (3) is slim hose or hard tube. The acoustic wave transmission channels are made of insulating materials. The micro loudspeaker (5) and the microphone (6) are placed in the main body (4). The acoustic wave transmission channels connect the main body (4), and the micro loudspeaker (5) on one end with the earplug and cover (1) on the other end. The slim channel in the middle is the acoustic wave transmission channels (3). The micro loudspeaker (5), the microphone (6), the conductor (8) and the plug (9) are connected in sequence. The conductor is metal shield line. The length of acoustic wave transmission channel (3) is 155 mm; the inner diameter of acoustic wave transmission channel (3) is 2 mm; the volume of sound cavities (2) is 600 $mm^3$; the outlet of sound cavities has one 2 mm or several 1.0 mm small holes, and makes sound cavities a small sound box.

It is featured that:

1) the acoustic wave concentrated orifice (10) is set between the micro-loudspeaker (5) and the acoustic wave transmission channels (3). A sealed small box is placed in the main body (4). The joint of acoustic wave concentrated orifices (10), the loudspeakers (5) and the acoustic wave transmission channels are sealed in the sealed small boxes (11) in the main body (4); the microphone (6) and the switch (12) are placed in the main body (4). The acoustic wave concentrated orifices (10) are inversely conical and opposite to the loudspeaker sidewise or face to face. The cross section of the inversely conical concentrated orifice is ellipse or polygon. The angle between the two pairs of bevel edges of the acoustic wave concentrated orifices (10) peripheral is 130° (symmetrical). Both of angles are both inverse loudhailer. One of angles can be inverse loudhailer while another is parallel. Cross section of inverse loudhailer and bottom surface of the cone are rectangle or polygon. The angle between the two pairs of bevel/arc/curve edges of the acoustic wave concentrated orifices (10) peripheral is 65° or unsymmetrical 25° or 40°. Asymmetry here means the angle between the two pairs of bevel edges of the acoustic wave concentrated orifices (10) peripheral is unsymmetrical. The angle between the left bevel/arc/curve edges and centerline is 25° while angle between the right bevel edge and centerline is 40° or vice versa.

2) Sound produced by the loudspeakers (5) is transmitted to the two acoustic wave channels via the acoustic wave concentrated orifices (10), and then through the acoustic wave transmission channel is sent to the two earplugs for listening by ears.

3) The loudspeakers stated above are sealed in a small box; the microphones is sealed in another small box in main body with its sound receiving side outward so that sound can be transmitted to microphone via sound receiving holes (one or more) on the main body and then through sound receiving holes (one or more) on the surface of the microphone, therefore, there is no echo and noise in the microphone to interfere the loudspeakers.

4) Two ways to tighten acoustic wave transmission channels to improve tensile strength as follows, one of both methods should be selected when tightening:

The earplug heads' inlet and the main body's outlet are sheathed by the acoustic wave transmission channels. The acoustic wave transmission channels' ends are tightened by sheaves 17-2.

Embodiment 5

The safety earplug device is featured that: besides the acoustic wave concentrated orifices is inverse loudhailer shaped, said inverse loudhailer shaped can be as the following species:

1) the inverse loudhailer peripheral being arc inverse loudhailer shaped;

2) the inverse loudhailer peripheral being slope inverse loudhailer shaped;

3) the inverse loudhailer peripheral being curve inverse loudhailer shaped;

4) the inverse loudhailer peripheral being shaped by arc (or curve) inverse loudhailer and slope inverse loudhailer together.

Figure 2:
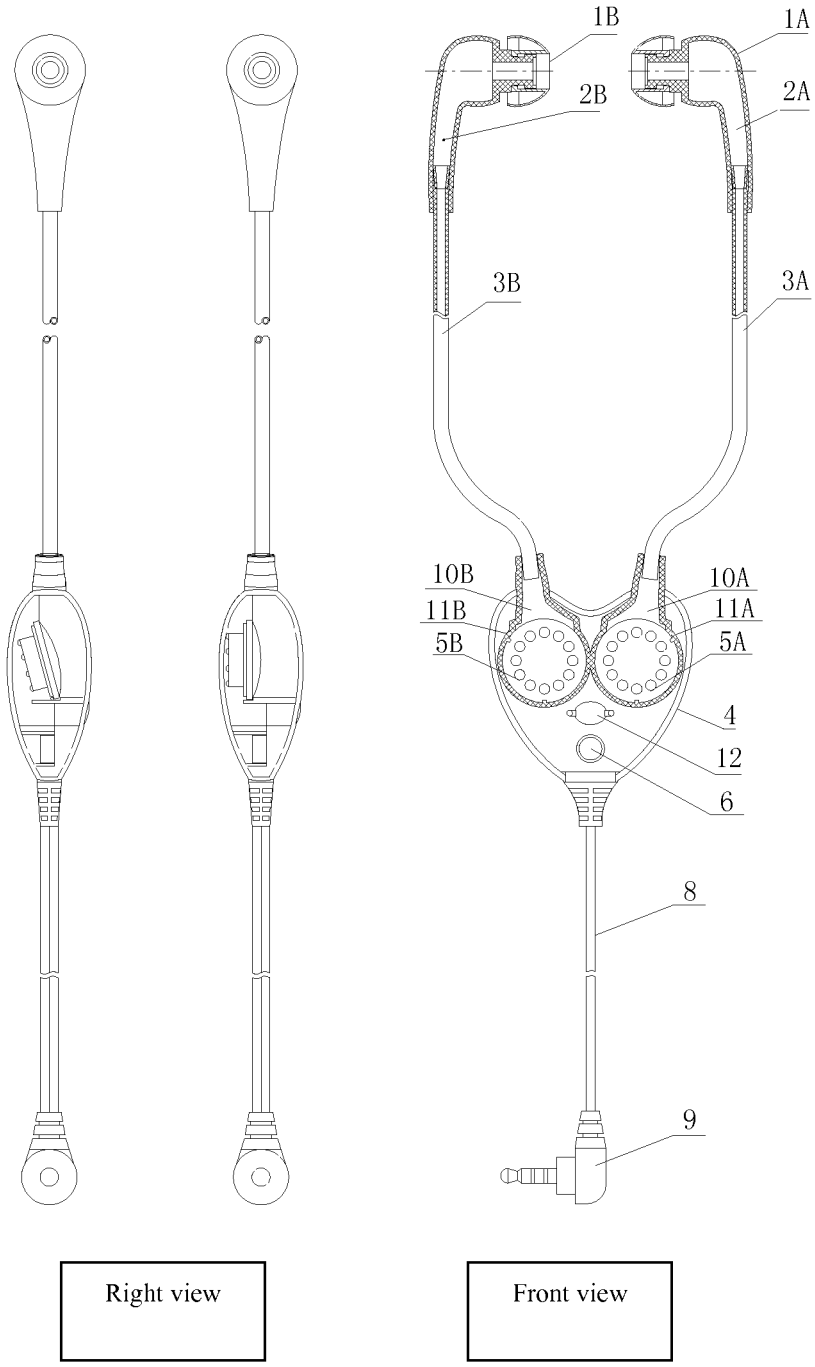
FIG. 2: A safety earplug device has two loudspeakers which are placed flat or slant and unsymmetrical acoustic wave concentrated orifices.
Figure 3:
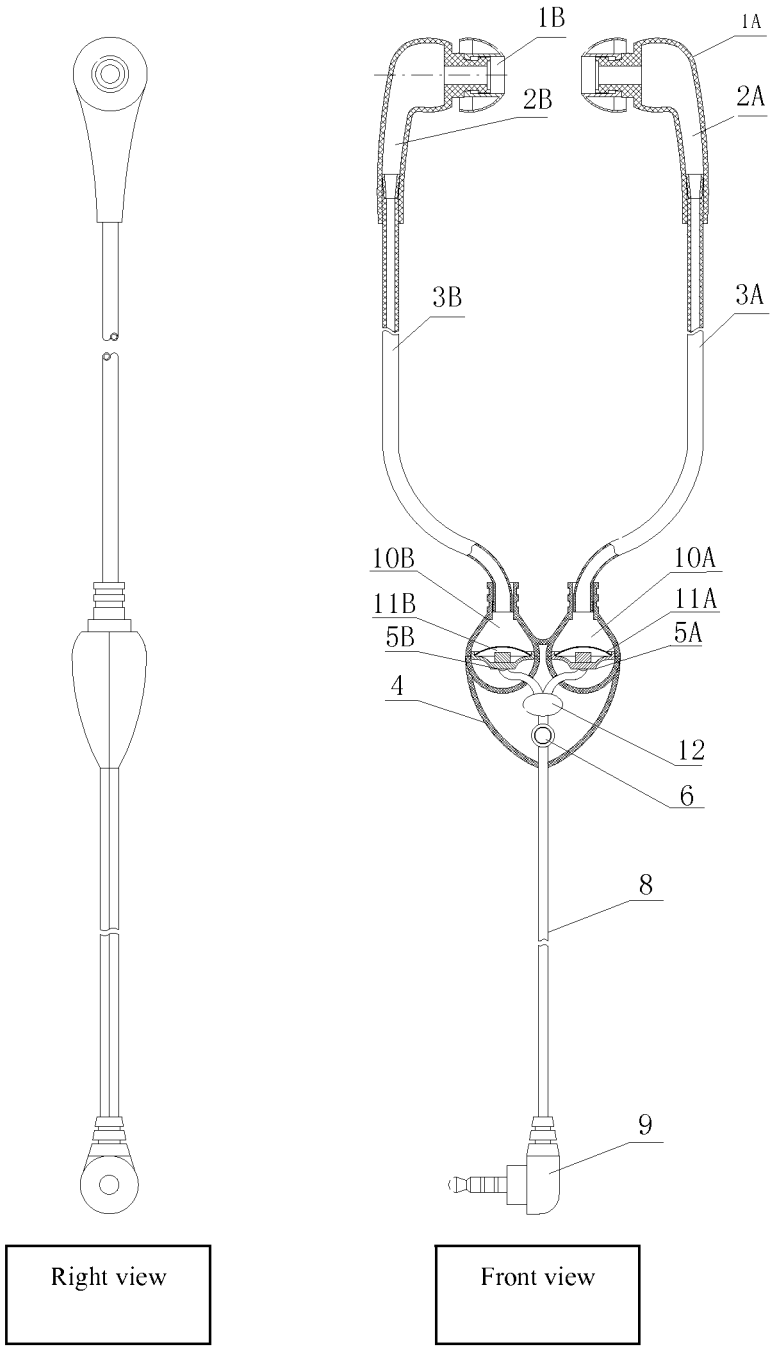
FIG. 3: A safety earplug device has two loudspeakers which are placed vertically and acoustic wave concentrated orifices.
Figure 4:
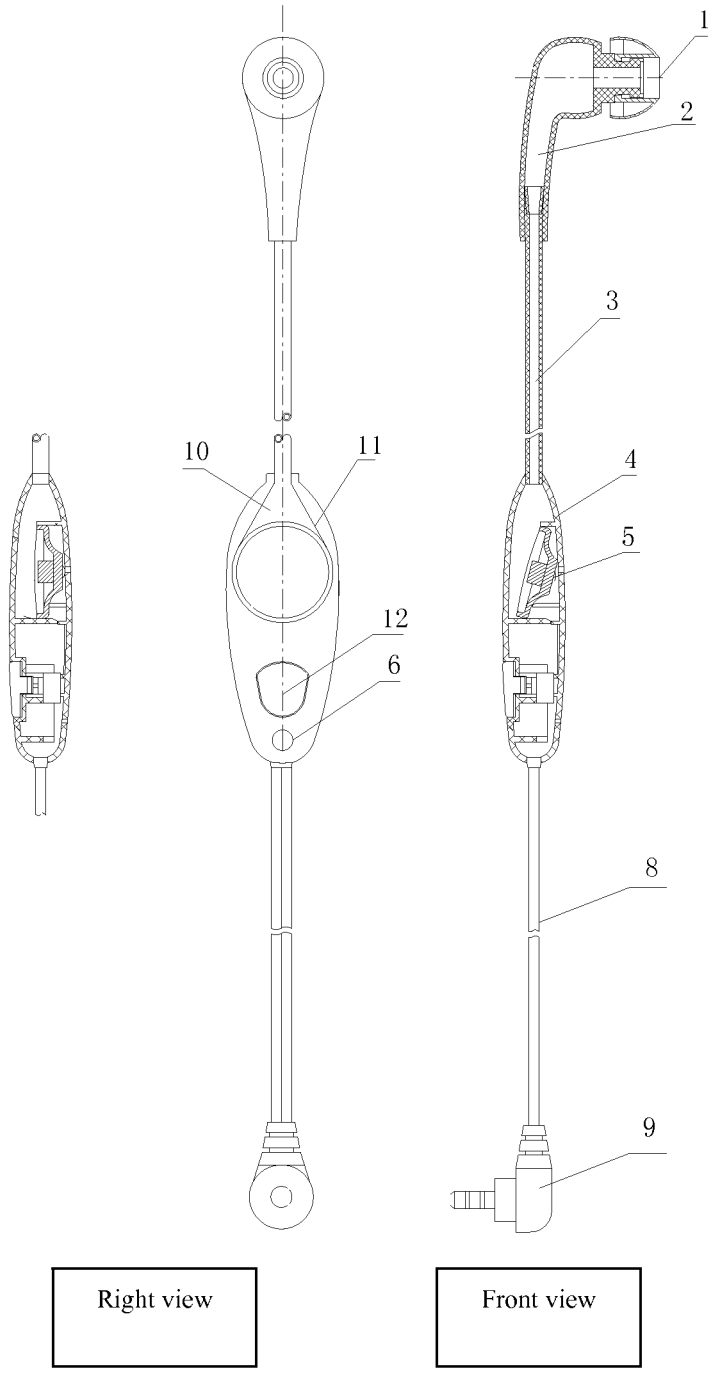
FIG. 4: A safety earplug device has a loudspeaker which is placed flat or leaning and symmetrical acoustic wave concentrated orifices.

The safety earplug device is featured that: its structure is the same as described in one of FIGS. 1-4 except the angle between two pairs of bevel/arc/curve edges of the acoustic wave concentrated orifices (10) peripheral is 60° (unsymmetrical). Asymmetry means that the angle between the two pairs of bevel edges of the acoustic wave concentrated orifices (10) peripheral is unsymmetrical. The angle between left bevel edge and the centerline is 51° while the angle between right bevel edge and the centerline is 9° or vice versa.

Embodiment 6

The safety earplug device is featured that: its structure is the same as described in one of FIGS. 1-4, besides that the angle between two pairs of the bevel edges of the acoustic wave concentrated orifices (10) peripheral is 40° (unsymmetrical). Asymmetry means that the angle between the two pairs of bevel edges of the acoustic wave concentrated orifices (10) peripheral is unsymmetrical. The angle between left bevel edge and centerline is 35° while angle between the right bevel edge and centerline is 5° or vice versa.

Embodiment 7

Figure 5:
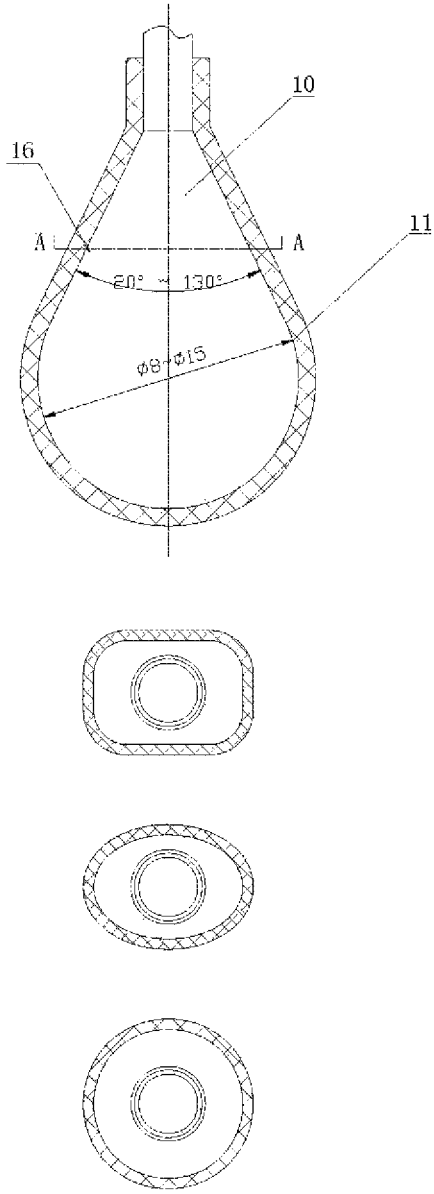
FIG. 5: A safety earplug device has a loudspeaker, an acoustic wave transmission channel and a small sealed box with symmetrical acoustic wave concentrated orifices. The angle between the two pairs of bevel/arc/curve edges of the acoustic wave concentrated orifices (10) peripheral is symmetrical 20°-130°; A-A cross sections are round, ellipse or polygon (cross section is not illustrated).
Figure 6:
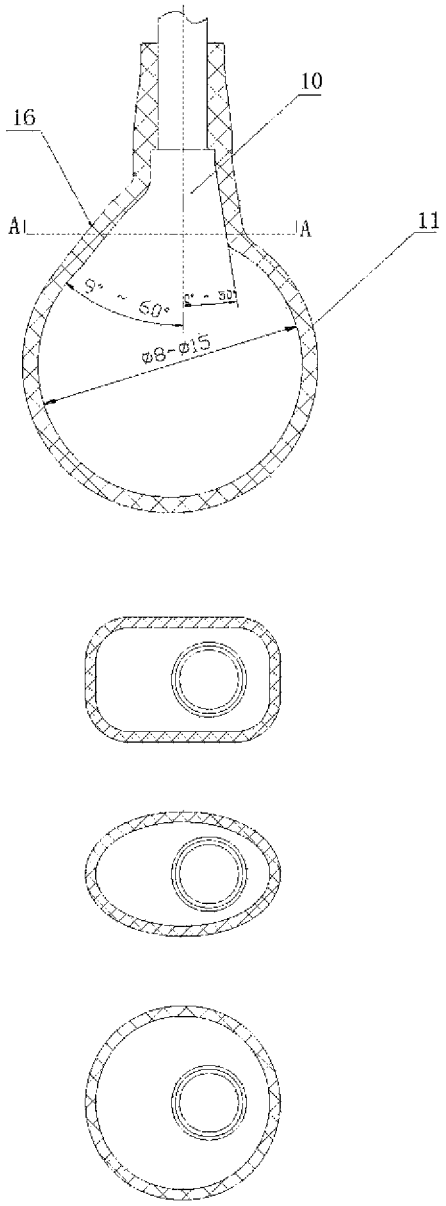
FIG. 6: the small sealed box jointed unsymmetrical acoustic wave concentrated orifices of an acoustic wave transmission channel. The angle between the left bevel/arc/curve edges and centerline is unsymmetrical 9°-60° and 0°-50°; A-A cross sections are round, ellipse or polygon (cross section is not illustrated)
Figure 7:
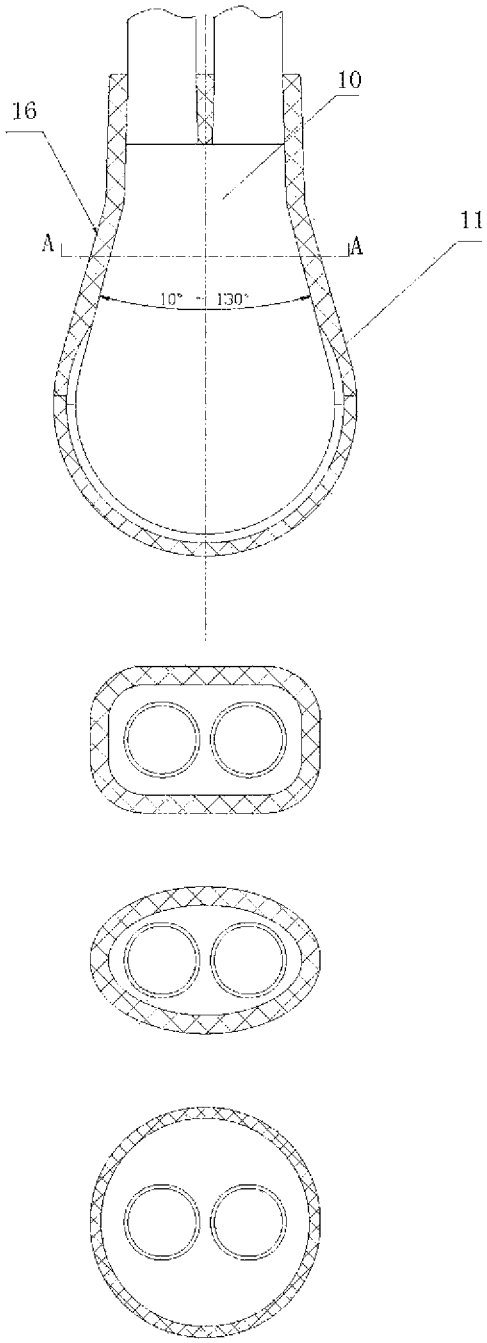
FIG. 7: A safety earplug device has a loudspeaker and a small sealed box jointed with two acoustic wave transmission channels. The angle between two pairs of bevel/arc/curve edges of the acoustic wave concentrated orifices (10) peripheral is symmetrical 10°-130°; A-A cross sections are round, ellipse or polygon (cross section is not illustrated)
Figure 8:
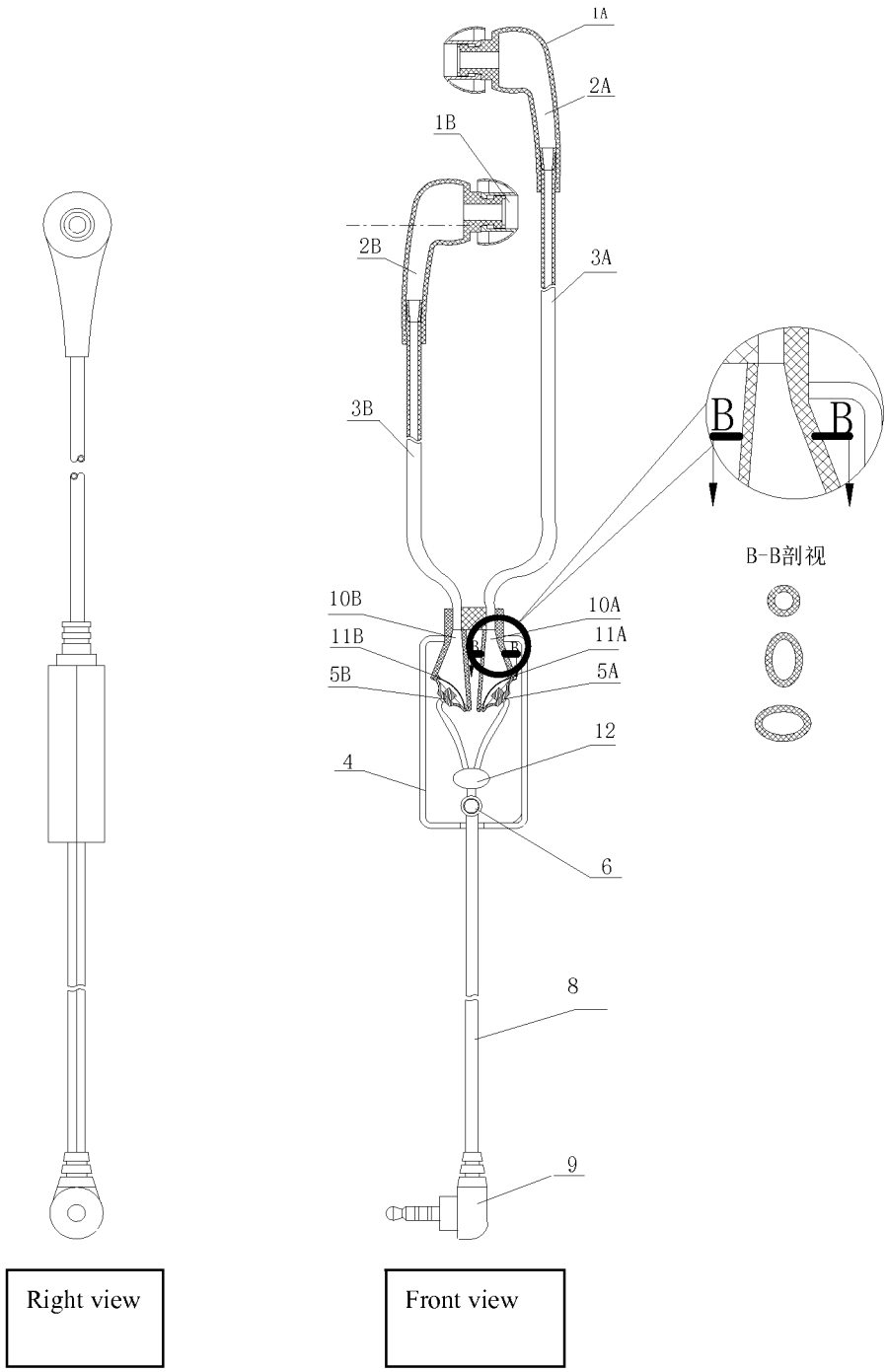
FIG. 8: A safety earplug device has two speakers which are placed vertically with different shapes of acoustic wave concentrated orifices and rectangle-shaped main body. Acoustic wave concentrated orifices 10A and 10B can be different in shape; B-B cross sections are round, ellipse or polygon (cross section is not illustrated).
Figure 9:
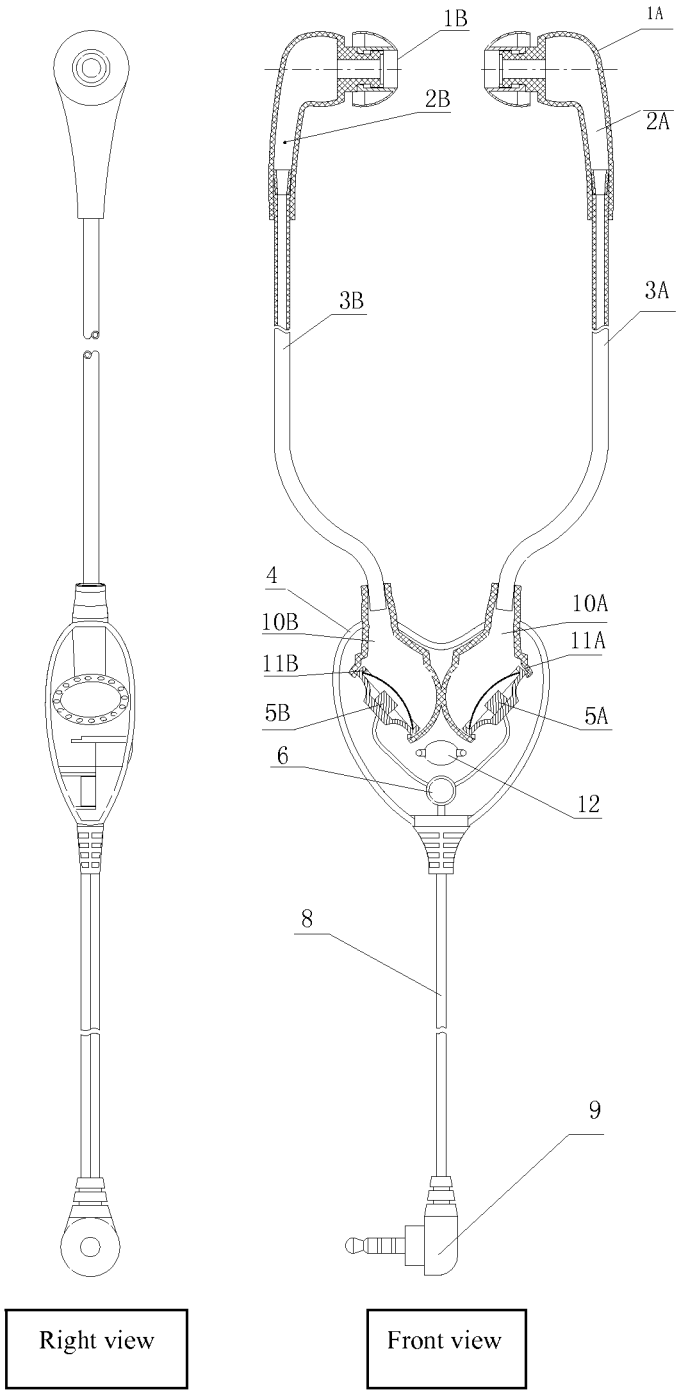
FIG. 9: A safety earplug device has two speakers which are placed vertically with different shapes of acoustic wave concentrated orifices and heart-shaped main body.
Figure 10:
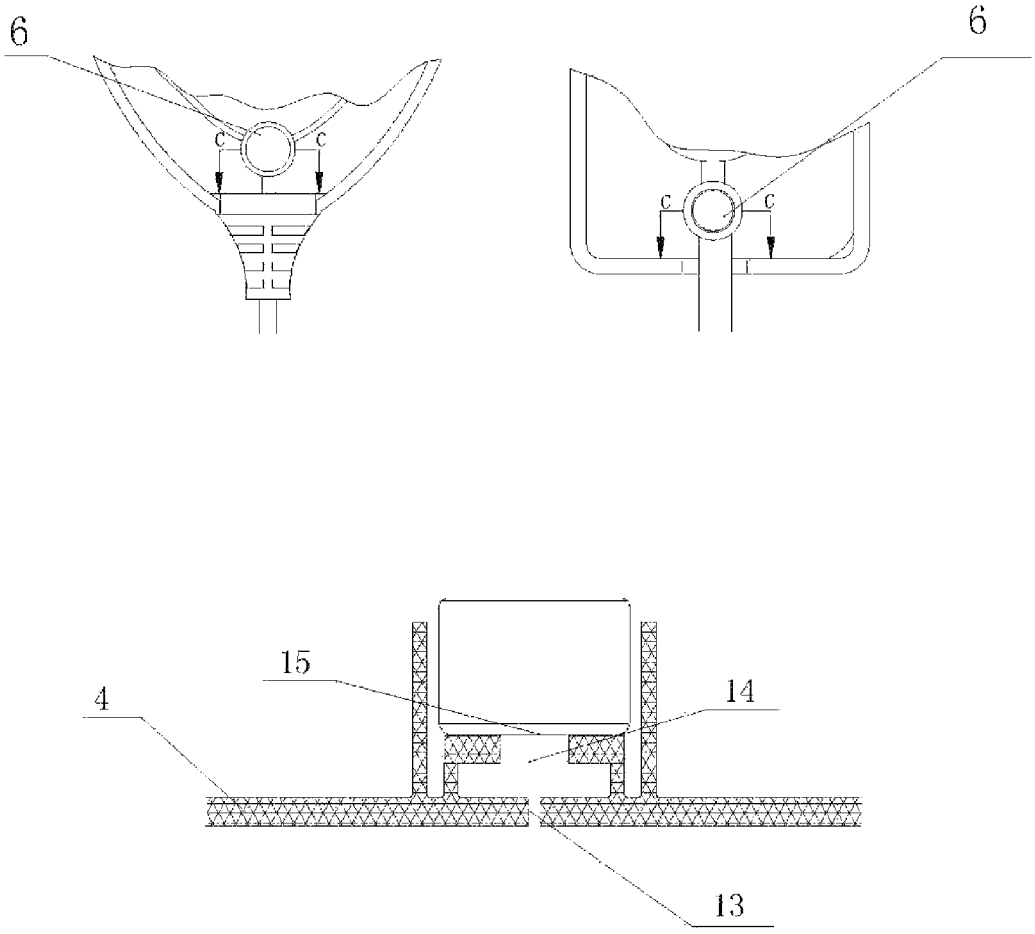
FIG. 10: C-C cross section of microphones of FIGS. 8 and 9.

The safety earplug device is featured that: its structure is the same as described in one of FIGS. 1-6, besides that the angle between two pairs of the bevel edges of the acoustic wave concentrated orifices (10) peripheral is 18° (symmetrical).

Embodiment 8

The safety earplug device is featured that: its structure is the same as described in one of FIGS. 1-6, besides that the angle between two pairs of bevel edges of the acoustic wave concentrated orifices (10) peripheral are 60° (unsymmetrical). Asymmetry means that the angle between two pairs of the bevel edges of the acoustic wave concentrated orifices (10) peripheral is unsymmetrical. The angle between left bevel edge and the centerline is 51° while angle between right bevel edge and the centerline is 9° or vice versa.

Embodiment 9

The safety earplug device is featured that: its structure is the same as described in one of Illustration 1-6 besides that the angle between two pairs of the bevel edges of the acoustic wave concentrated orifices (10) peripheral is 120° (symmetrical).

Embodiment 10

The safety earplug device is featured that: its structure is the same as described in one of Illustration 1-6 besides that the angle between two pairs of bevel edges of the acoustic wave concentrated orifices (10) peripheral is 100° (symmetrical).

Embodiment 11

The safety earplug device is featured that: its structure is the same as described in Illustration 10 besides that the micro-loudspeakers are placed vertically in main body (4).

Embodiment 12

The safety earplug device is featured that: its structure is the same as described in Illustration 10, besides that the micro-loudspeakers are placed flat or slant in the main body (4).

Embodiment 13

The safety earplug device is featured that: its structure is the same as described in Illustration 12, besides that it has 2 micro-loudspeakers (5): 5A and 5B.

The embodiments described above is for better understand the principles of this invention, thus not limited to the protective scope of this invention

What is claimed is:

1. A safe in-ear earphone comprising:

an earplug with cover;

a sound cavity, it has an enlarged cavity with an outlet to become a small sound box, the earplug cover covers on the cavity;

a main body, it has a chamber for an electronic control plate and a microphone and a sealed box consisted of an acoustic wave concentrated orifice, an connecting interface and a micro-loudspeaker;

the acoustic wave concentrated orifice has an inversely loudhailer shape with a pair of bevel/arc/cur edges having 20° to 130° included angle which are symmetrical or no-symmetrical, a cross section of the acoustic wave concentrated orifice is a rectangle or polygon or ellipse, the acoustic wave concentrated orifice, connecting interface and an acoustic wave transmission channel have common axis and are connected together in series;

the micro-loudspeaker is of seal connection with the inversed loudhailer of the acoustic wave concentrated orifice, a pronunciation face of the micro-loudspeaker is against the acoustic wave concentrated orifice in sidewise or aspectant;

the acoustic wave transmission channel is a slim hose or hard tube, which connects the sound cavity at one end and the connecting interface at other end;

a microphone, it is sealed in the chamber for electronic control plate with its sound receiving face outward to sound receiving holes which are on a wall of the chamber for the microphone, therefore, there are no echo and noise from the microphone to interfere acoustic wave of the loudspeakers;

a plug, which connects the electronic control plate by a conducting plug line made of metal shielding line.

2. The safe in-ear earphone of claim 1, wherein said inversely conical acoustic wave concentrated orifice has a inversely loudhailer shape with a pair of bevel or arc or cur edges, having no-symmetrical included angle which are 9° to 60° and 0° to 50° between the pair of ecges.

3. The safe in-ear earphone of claim 1, wherein the sound cavity and earplug cover consists a earplug, which is plugged in a ear for listening, the main body having the micro-loudspeaker therein is far away the earplug and is connected with the earplug by the acoustic wave transmission channel, sound from micro-loudspeaker passes through the acoustic wave concentrated orifice and the acoustic wave transmission channel enters in the sound cavity for listening, thereby the ear is far away the high frequency magnetic field and intense radiation from the micro-loudspeaker or mobile phone.

4. The safe in-ear earphone of claim 1, wherein micro-loudspeaker is round or ellipse.

5. The safe in-ear earphone of claim 1, wherein said acoustic wave transmission channel has a length of 110 mm-600 mm, an inner diameter of 2-4 mm; a volume of said enlarged sound cavity is 600 $mm^3$ to 3000 $mm^3$, a diameter of a small hole of an outlet of the sound cavity is 1.5 mm-4 mm or 0.3-1.5 mm.

6. The safe in-ear earphone of claim 1, wherein the sealed box has one of the micro-loudspeakers and two of the acoustic wave concentrated orifices, thereby the safe in-ear earphone has two ear earphones.

7. The safe in-ear earphone of claim 1, wherein one end of said acoustic wave transmission channels is inserted into an earplug's inlet while the other end is inserted into the connection interface of the acoustic wave concentrated orifice, then each ends of the acoustic wave transmission channels is inserted a hollow rivet, which is bulged to have a tight connection therebetween, each hollow rivet has a smoothed inner face and angle of chamfer, which are benefit to reduce resistance for acoustic wave.

8. The safe in-ear earphone of claim 1, wherein an earplug's inlet and a connection interface of the acoustic wave concentrated orifice are connected by the acoustic wave transmission channel, two ends of the acoustic wave transmission channel are on two ends of the two connected parts respectively and are tightened therein by two sheaves.

* * * * *